United States Patent [19]

Corrigan

[11] Patent Number: 4,817,735

[45] Date of Patent: Apr. 4, 1989

[54] FOOT POWERED ICE AUGER

[76] Inventor: Robert F. Corrigan, 654 Eastgate Dr., Frankenmuth, Mich. 48734

[21] Appl. No.: 618,942

[22] Filed: Jun. 8, 1984

[51] Int. Cl.[4] ..... F25C 5/04

[52] U.S. Cl. ..... 173/30; 173/171; 175/18

[58] Field of Search ..... 173/30, 18, 140, 148, 173/171; 175/394, 18; 408/124, 120, 128, 139; 144/103, 104, 93 R, 92; 83/477 R

[56] References Cited

U.S. PATENT DOCUMENTS

| | | | |
|---|---|---|---|
| 68,362 | 9/1867 | Grimshaw | 144/92 |
| 357,182 | 2/1887 | Darling | 83/477.2 |
| 825,791 | 7/1906 | Young | 408/128 |
| 1,191,588 | 7/1916 | Groom | 144/93 R |
| 3,731,751 | 5/1973 | Rusco | 175/18 |
| 4,116,284 | 9/1978 | Cox | 173/30 |

*Primary Examiner*—Frank T. Yost
*Assistant Examiner*—James L. Wolfe

[57] ABSTRACT

An ice auger driven manually by foot power through the instrumentality of a foot driven ratchet drive rotatably affixed to a set of bevel gears permanently mounted in a framework affixed to a stable base. An assymetrically shaped auger shaft with a rotatably mounted handle assembly and a permanently attached auger head is positioned vertically through, but not affixed to, the assymetrical bore of the horizontally positioned bevel gear permitting vertical movement of the shaft within the bore during operation. The combination of rotation created by the operation of the ratchet, the constant rotational force point on the auger shaft at the assymetrical bore of the horizontal bevel gear, combined with the simultaneous vertical movement of the auger shaft, results in a constantly changing point on the shaft where the bevel gear imparts rotational force. The vertical movement of the auger shaft is facilitated by the operator's downward pressure on the handle.

4 Claims, 3 Drawing Sheets

FOOT POWERED ICE AUGER

BACKGROUND AND SUMMARY OF INVENTION

This invention relates to ice augers primarily used in the sport of ice fishing. This invention also has relation to use of foot power as a power source not heretofore available in manually powered ice augers. By utilization of foot power, ice fishermen have the advantage of a low-cost, light-weight, work efficient manual auger, and the elimination of losing the auger down a freshly drilled hole should it slip out of cold hands.

Presently two major types of ice augers are available to bore holes in ice, the (1) motorized and the (2) manual auger.

(1) Several versions of the motorized auger exist. The most common being a gasoline engine mounted directly atop an auger when the auger is in a position to bore a hole in the ice, other adaptations using the gasoline engine have also been used. U.S. Pat. No. 2,982,364 uses a sled mounted gasoline engine while U.S. Pat. No. 3,731,751 uses a power take-off from a snowmobile. These methods are effective but require substantial initial investment, maintenance expenses, transportation of heavy and bulky equipment, as well as operational expenses. Consequently there has not been wide-spread acceptance of power driven ice augers by the average ice fisherman because of the related costs and limited use to which this specialized equipment can be put.

(2) Manually operated ice augers are the most common method used to bore holes in ice. Although several variations of design are available, essentially manually operated ice augers are based on the principle of a carpenter's brace and bit. The manual auger's popularity is based on its relative low cost, simplicity of operation, light weight and portability. Disadvantages of current manually operated ice augers include considerable physical energy input to operate and loss of the auger if dropped through a freshly bored hole because it slips out of cold hands.

In both instances, whether motorized or manually operated, the power source for rotating the auger shaft of existing augers is fixed at or near the end of the auger shaft distant from the cutting edge of the auger head.

The foot powered auger of the present invention circumvents the need to have the rotational power source of the auger shaft affixed at the terminal end of the auger shaft remote to the cutting edge of the auger as is the case in augers of the present art. Through the use of an assymetrically designed auger shaft which passes through and mates with an identically designed bore of a bevel gear it becomes possible to place the power source (ratchet assembly and bevel gears) in a stationary relationship and in close proximity to the surface of the ice and to effect a constantly changing transmission point of rotational power to the auger shaft so the foot can be used as a power source to operate the ratchet arm and thereby effect the boring process.

The assymetrical shaft passing through the matching bore of the horizontally positioned bevel gear causes the shaft to rotate during the power stroke of the ratchet arm. Since the auger shaft is not affixed permanently within the bore of the horizontal bevel gear, the auger shaft simultaneously rotates within and is free to descend through the bore of the gear as the auger blades cut deeper into the ice. This design feature of an assymetrical auger shaft and matching assymetrical bevel gear bore makes it possible to have the point where the rotational power is transmitted from the bevel gear's operation to the auger shaft change with each power stroke of the ratchet arm. Thus the point on the auger shaft where the driven gear imparts rotational force to the auger shaft varies during and following each power stroke and can at any given moment be anywhere on the auger shaft from just above the auger shaft's cutting edge to a point totally distant therefrom. The change in the point on the auger shaft where the rotational force is imparted by the bevel gear will be dependent upon the downward pressure applied by the operator on the outwardly extending handle mounted on top of the auger shaft and the depth of the cut by the auger blades during each power stroke.

Through the combination and interdependency of the above auger shaft assembly and the ratchet arm and bevel gear assembly with special assymetrical bore it is possible to design a manually operated ice auger that does not require the rotational force of the auger shaft to be affixed permanently at the end of the auger shaft remote from the cutting edge and secondly because the point where rotational force is imparted to the auger shaft changes with each stroke of the ratchet, the power assembly (ratchet and bevel gears) can be positioned just above and stationary in relationship to the surface of the ice to make it physiologically possible to utilize foot power to operate an ice auger. These combined means make it possible to utilize an alternative method to bore holes in ice that heretofore has not been available in the prior art.

Other objects and advantages of the invention will become readily apparent from the following description and drawings.

DESCRIPTION OF THE PREFERRED EMBODIMENTS

Figure 1:
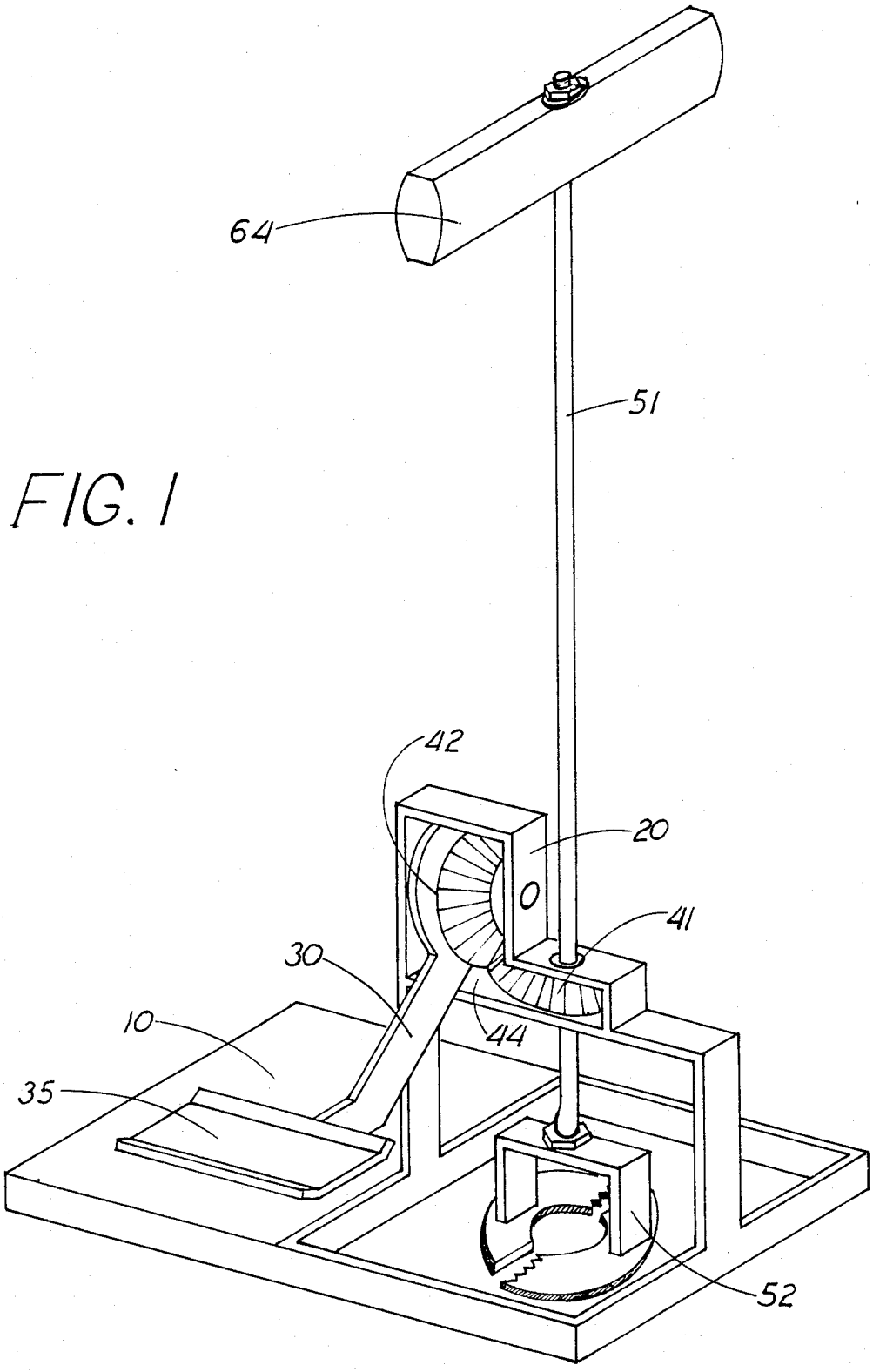
FIG. 1 A perspective view of the foot powered ice auger of the present invention positioned for use.
Figure 2:
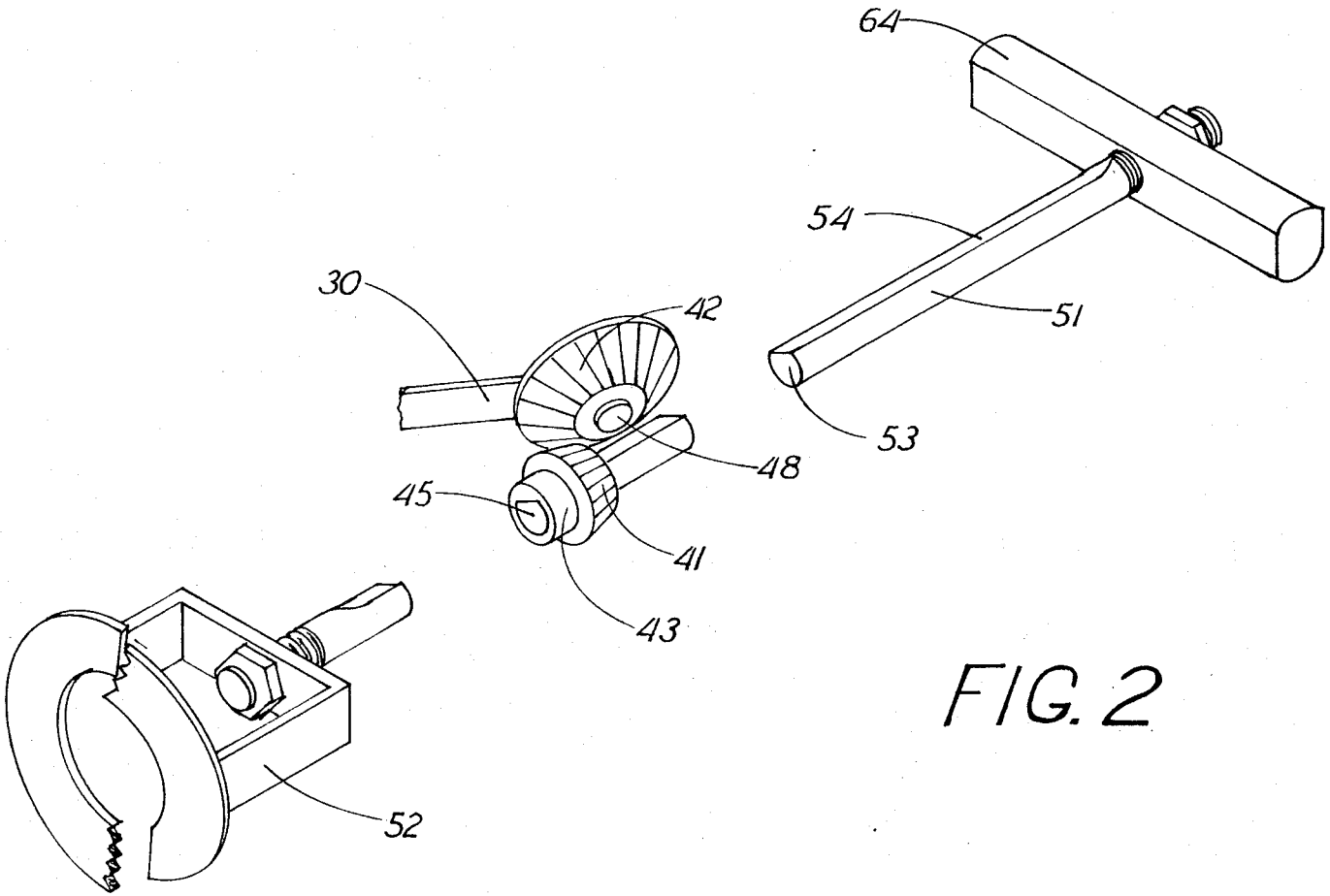
FIG. 2 An exploded view of the preferred form of the invention illustrating further structural details of the assymetrical auger shaft, the assymetrical bore of the bevel gear, and the relationship of the bevel gears to the auger shaft.
Figure 3:
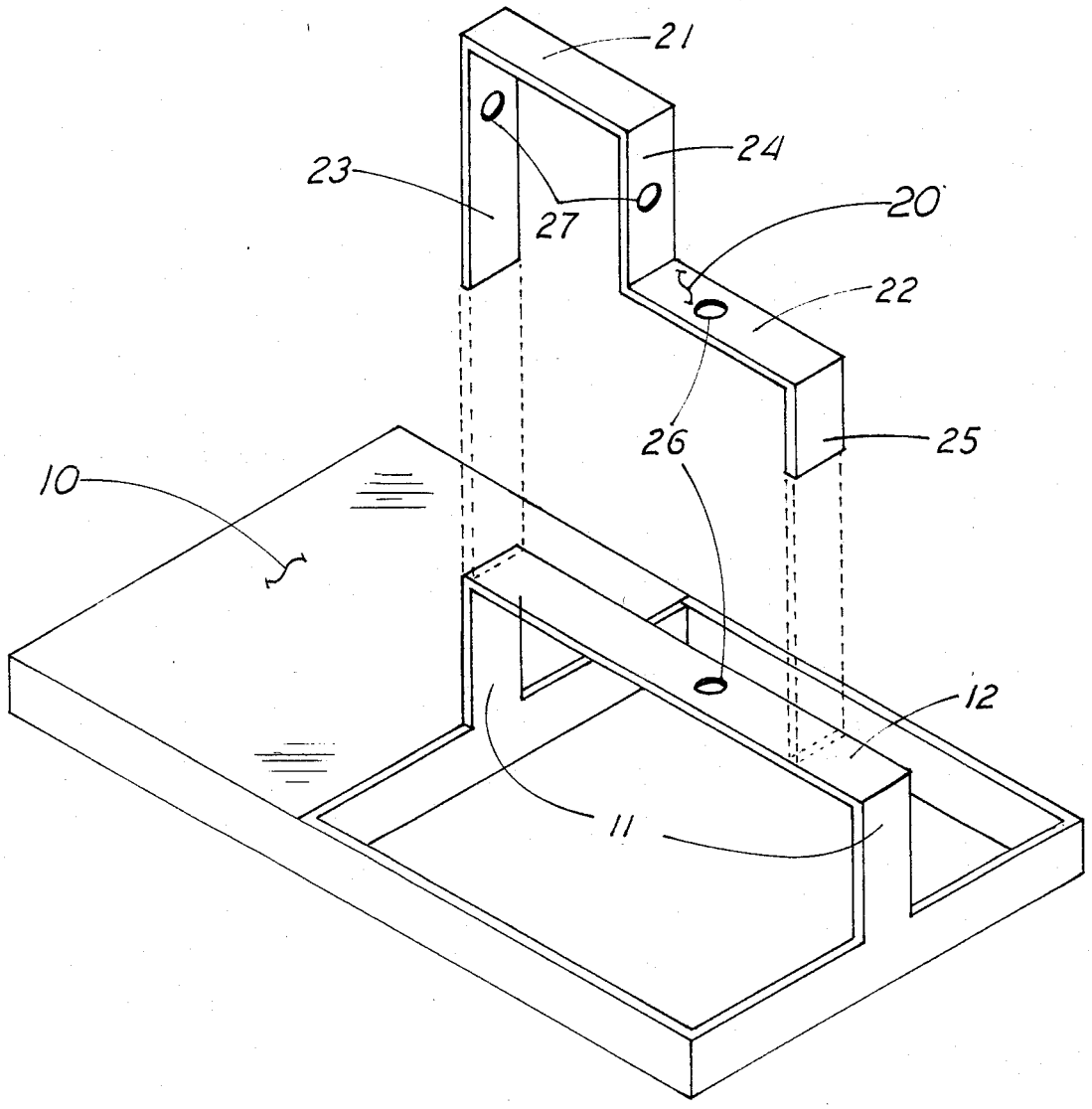
FIG. 3 A perspective view of the frame and its component parts in relationship to the base.

In the form of the invention as disclosed in FIGS. 1 2, and 3 a foot powered ice auger apparatus FIG. 1 is shown in operative relationship to the surface of the ice. In order to maintain proper and perpendicular relationship of the auger and auger shaft assembly 51 to the surface of the ice, and to provide a housing for the bevel gears, 41, 42 and the ratchet arm 30 assembly, a base 10 and frame 20 assembly is fabricated.

The base 10 is constructed of any material of suitable strength and rigidity to provide a sound foundation for the auger shaft assembly 51 and for the frame 20 that houses the bevel gears, 41, 42 and ratchet arm 30. The base 10 is constructed to provide a flattened area that rests on the surface of the ice; two vertical uprights 11 and a cross member 12 are affixed thereto. The vertical uprights and the cross member from the upper portion of the base and is perpendicular to the surace of the ice.

The inside dimensions of the base's foundation that rests on the ice is wide enough to accomodate the width of the auger head; the vertical distance from the surface of the ice to the cross member 12 is sufficient to allow the auger head to rotate freely when positioned thereunder.

Mounted immediately above and aligned with the cross member 12 of the base is the frame 20; the frame is of similar construction as the base 10. The frame consists of two cross member 21 and 22, joined to the three vertical uprights 23, 24, and 25 as depicted in FIG. 3. This framework with its components permanently and rigidly affixed to each other effectuate a housing for the ratchet arm 30 and bevel gears 41, 42. The frame is constructed to house the bevel gears 41, 42 and ratchet arm 30 in permanent and proper alignment to each other while allowing free and unrestricted operation of the ratchet arm and bevel gears located therein.

The bevel gears 41, 42 are mounted fixedly in frame 20 by having their journals 43 and 48 inserted into the holes 26 and 27 respectively of the frame. The long axis of the bore 45 of the driven gear 41 is perpendicular to the ice and is positioned in a manner that centers its bore above the previously described space within the base 10 to accommodate the auger head.

The ratchet arm drive 30 with pedal footrest 35 affixed pivotably by any suitable means to the terminal end of the ratchet arm distant from the frame is mounted to the integrally cast journal 48 protruding from the largest diameter face of the driving bevel gear 42 in a suitable manner to allow free rotatability of the ratchet drive arm in a counter clockwise direction, and to engage and rotate the driving gear 42 during the downward or clockwise power stroke. The ratchet arm will be mounted within the frame 20, between vertical upright 23 and the driving gear 42 as depicted in FIG. 1. The driving gear 42 is mounted between upright 23 and 24 of the frame. Completion of the power gear assembly installation is effected when the power gear assembly (ratchet drive 30 and bevel gear 41 and 42) are intermeshed within the frame 20 at point 44 and are positioned at right angles to each other; the driving gear 42 being vertical and the driven gear 41 being horizontal respectively to the surface of the ice as depicted in FIG. 1.

The auger shaft assembly consists of the auger head 52 and the auger shaft 51. The auger head is attached to the auger shaft 51 by any suitable means that rigidly fixes the auger head at the bottom of the auger shaft 51 in a manner that forces the auger head to rotate in concert with the auger shaft during operation. The auger shaft has a flat sided surface 54 making the shaft assymetrical shaped 53 in design. The auger shaft is positioned in the ice auger mechanism by inserting the upper end of the auger shaft 51 up through the matching assymetrical bore 45 of the driven gear 41; positioning is complete when the upper structure of the auger head 52 comes in contact with the lower surface of cross member 12 of the base 10.

A handle 64 is mounted by any suitable means to the upper end of the auger shaft 51 and extends laterally therefrom. The handle is affixed to allow free rotation of the auger shaft within the handle while maintaining a constant position at the upper end of the auger shaft.

IN OPERATION

In operation the parts are assembled as seen in FIG. 1, and the foot powered ice auger is positioned in perpendicular relationship to the surface of the ice which is to be cut. The operator effects the boring process by positioning himself with one foot on the base 10. This effectively negates counter torque produced by auger head rotation and penetration during operation; the operator's other foot is mounted in and secured to the pedal footrest 35 by any suitable means. The operator places his hands in a palm down grasping manner on the handle extension 64. The boring process is effected by the operator lifting the foot ratchet arm 30 with his operational foot and thence applying downward pressure on said ratchet arm 30. This force activates the driving gear 42 which in turn causes the driven gear 41 to rotate within the framework 20. The auger shaft 51 with its assymetrically design 53 is forced to rotate synchronously with the driven gear 41; this is accomplished through the matching assymetrical bore 45 of the driven gear mating with the auger shaft's assymetrical flattened surface 54. As the auger shaft rotates the boring process if furthered by the downward pressure being applied simultaneously to the outward extensions of the handle 64 by the operator. The assymetrical design of the auger shaft 53 and the matching assymetrical bore 45 of the driven gear 41 forces the auger shaft 51 and auger head 52 to rotate in concert with the rotation of the driven gear 41. However, since the auger shaft 51 is not permanently affixed within the bore 45 of the bevel gear it is free to slide downward in response to the operators pressure on handle 64 while simultaneously rotating. The operator continues the boring process by repetitious strokes of the ratchet arm 30; on each stroke the auger head penetrates further into the ice and the auger shaft 51 moves downward with and during every rotation. This effects a new and ever changing point on the auger shaft 51 where the driven gear 41 through its assymetrical designed bore 45 transmits rotational force to the auger shaft. The boring process is complete when the auger shaft 51 has simultaneously rotated and moved downward through the bore 45 of the driven gear to a point where the auger head has cut through the thickness of the ice.

The foregoing disclosure and description of the invention are illustrative and explanatory thereof, and various changes in size, shape, and materials as well as in the details of the illustrated construction may be made without departing from the spirit of the invention.

What is claimed, the embodiments of the invention in which an exclusive property or privilege is claimed are as follows:

1. A manually foot powered ice auger using a foot driven ratchet drive means secured to a bevel gear assembly means which is interfaced to an auger shaft means in a manner to effect rotational movement of the auger shaft without being affixed thereto, thus facilitating free vertical movement of the shaft during operation; to the auger shaft means is permanently attached an auger head on one end and to the other a handle assembly which permits free rotation of the auger shaft within the handle assembly; this combination of means is housed in and supported by a framework secured to a base means that maintains the relationship and alignment of the subassembles.

2. In combination with claim 1, a power gear assembly, including a ratchet and set of bevel gears, which makes it possible to design an ice auger that places operational power source of the auger in a framework that is located in a stationary relationship and close proximity to the surface of the ice, thus making it possible to use foot power to effect the boring process.

3. In combination with claim 1, design of a bevel gear with an assymetrical bore that mates with an identical assymetrical designed auger shaft that in combination during operation effect rotational movement of the auger shaft without the auger shaft being pemanently affixed thereto or therein, thus the point on the auger shaft where rotational force is imparted by the driven bevel gear changes with each rotation of the auger shaft; the rotational force constantly and consistently moves from one extremity of the auger shaft to the other during operation.

4. In combination with claim 1, an assymetrical designed bore in a bevel gear that mates with an identical assymetrically designed auger shaft that in combination effect rotational movement of the auger shaft without the auger shaft being permanently affixed thereto or therein, and thereby permitting the auger shaft to move freely vertically within the bore of the driven gear during rotation.

* * * * *